US009080401B2

(12) United States Patent
Xu

(10) Patent No.: US 9,080,401 B2
(45) Date of Patent: Jul. 14, 2015

(54) FLUID DRIVEN PUMP FOR REMOVING DEBRIS FROM A WELLBORE AND METHODS OF USING SAME

(75) Inventor: Ying Qing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 578 days.

(21) Appl. No.: 13/455,879

(22) Filed: Apr. 25, 2012

(65) Prior Publication Data

US 2013/0284428 A1 Oct. 31, 2013

(51) Int. Cl.

| | |
|---|---|
| ***E21B 43/00*** | (2006.01) |
| ***E21B 27/00*** | (2006.01) |
| ***E21B 43/12*** | (2006.01) |

(52) U.S. Cl.

CPC ..... *E21B 27/005* (2013.01); *E21B 43/129* (2013.01)

(58) Field of Classification Search

CPC ..... E21B 43/38; E21B 43/121; E21B 27/00; E21B 27/005; E21B 34/06; E21B 43/02; E21B 43/129

USPC ..... 166/105, 1, 311, 330, 244.1, 67, 68

See application file for complete search history.

(56) References Cited

U.S. PATENT DOCUMENTS

| | | | |
|---|---|---|---|
| 2,787,327 | A | 4/1957 | Pearson et al. |
| 2,894,725 | A | 7/1959 | Baker |
| 3,023,810 | A | 3/1962 | Anderson |
| 3,332,497 | A | 7/1967 | Page, Jr. |
| 3,360,048 | A | 12/1967 | Watkins |
| 3,500,933 | A | 3/1970 | Burba, Jr. et al. |
| 4,059,155 | A | 11/1977 | Greer |
| 4,217,966 | A | 8/1980 | Garrett |
| 4,276,931 | A | 7/1981 | Murray |
| 4,335,788 | A | 6/1982 | Murphey et al. |
| 4,390,064 | A | 6/1983 | Enen, Jr. et al. |

(Continued)

FOREIGN PATENT DOCUMENTS

| | | | |
|---|---|---|---|
| CN | 2883658 | Y | 3/2007 |
| GB | 2348226 | A | 9/2000 |

(Continued)

OTHER PUBLICATIONS

Don M. Hannegan, et al., Technologies Manage Well Pressures, The American Oil & Gas Reporter, Sep. 2001, pp. 87-93, National Publishers Group Inc., U.S.A.

(Continued)

*Primary Examiner* — Kenneth L Thompson
*Assistant Examiner* — Michael Wills, III
(74) *Attorney, Agent, or Firm* — Steve Rosenblatt

(57) ABSTRACT

A downhole tool for moving fluid through the tool comprises a rotatable sleeve disposed within a bore of the tool. The sleeve includes an opened upper end and a closed lower end to define a cavity. A fluid movement profile is disposed along the lower end. A directional port is disposed in the side of the sleeve in fluid communication with the cavity and an upper port disposed in the tool. The upper port can be isolated from a lower port in the tool, the lower port being in fluid communication with the fluid movement profile. A first fluid flowing downward enters the cavity, exits the directional port causing rotation of the sleeve, and flows out the tool through the upper port. Sleeve rotation causes a second fluid to be drawn upward into contact with the fluid movement profile which directs the second fluid out of the lower port.

20 Claims, 4 Drawing Sheets

(56) References Cited

U.S. PATENT DOCUMENTS

| | | | |
|---|---|---|---|
| 4,515,212 | A | 5/1985 | Krugh |
| 4,588,243 | A | 5/1986 | Ramsey et al. |
| 4,828,026 | A | 5/1989 | Nelson |
| 4,857,175 | A | 8/1989 | Spinnler |
| 4,880,059 | A | 11/1989 | Brandell et al. |
| 5,228,518 | A | 7/1993 | Wilson et al. |
| 5,425,424 | A | 6/1995 | Reinhardt et al. |
| 5,524,709 | A | 6/1996 | Withers |
| 5,533,373 | A | 7/1996 | Plester |
| 6,112,812 | A | 9/2000 | Carter |
| 6,179,057 | B1 | 1/2001 | Fontana et al. |
| 6,202,752 | B1 | 3/2001 | Kuck et al. |
| 6,276,452 | B1 | 8/2001 | Davis et al. |
| 6,341,653 | B1 | 1/2002 | Firmaniuk et al. |
| 6,352,129 | B1 | 3/2002 | Best |
| 6,361,272 | B1 | 3/2002 | Bassett |
| 6,397,959 | B1 | 6/2002 | Villarreal |
| 6,427,776 | B1 | 8/2002 | Hoffman et al. |
| 6,446,737 | B1 | 9/2002 | Fontana et al. |
| 6,543,538 | B2 | 4/2003 | Tolman et al. |
| 6,568,475 | B1 | 5/2003 | Grubb et al. |
| 6,607,031 | B2 | 8/2003 | Lynde et al. |
| 6,655,459 | B2 | 12/2003 | Mackay |
| 6,719,071 | B1 | 4/2004 | Moyes |
| 6,755,256 | B2 | 6/2004 | Murley et al. |
| 6,951,251 | B2 | 10/2005 | Penisson |
| 7,069,992 | B2 | 7/2006 | Lewis et al. |
| 7,096,972 | B2 | 8/2006 | Orozco, Jr. |
| 7,096,975 | B2 | 8/2006 | Aronstam et al. |
| 7,114,581 | B2 | 10/2006 | Aronstam et al. |
| 7,174,975 | B2 | 2/2007 | Krueger et al. |
| 7,267,172 | B2 | 9/2007 | Hofman |
| 7,478,687 | B2 | 1/2009 | Lynde et al. |
| 7,497,260 | B2 | 3/2009 | Telfer |
| 7,513,303 | B2 | 4/2009 | Hern |
| 7,610,957 | B2 | 11/2009 | Davis et al. |
| 7,721,822 | B2 | 5/2010 | Krueger et al. |
| 7,753,113 | B1 | 7/2010 | Penisson |
| 7,806,203 | B2 | 10/2010 | Krueger et al. |
| 7,861,772 | B2 | 1/2011 | Blair |
| 7,987,901 | B2 | 8/2011 | Krueger et al. |
| 8,011,450 | B2 | 9/2011 | Krueger et al. |
| 2001/0050185 | A1 | 12/2001 | Calder et al. |
| 2003/0098181 | A1 | 5/2003 | Aronstam et al. |
| 2004/0251033 | A1 | 12/2004 | Cameron et al. |
| 2010/0243258 | A1 | 9/2010 | Fishbeck et al. |
| 2011/0024119 | A1 | 2/2011 | Wolf et al. |
| 2011/0203848 | A1 | 8/2011 | Krueger et al. |
| 2012/0160503 | A1 | 6/2012 | Davis |
| 2013/0168091 | A1 | 7/2013 | Xu et al. |

FOREIGN PATENT DOCUMENTS

| | | |
|---|---|---|
| WO | WO 99/22112 | 5/1999 |
| WO | WO 00/04269 | 1/2000 |
| WO | WO 00/08295 | 2/2000 |
| WO | WO 03/006778 A1 | 1/2003 |
| WO | WO 03/025336 A1 | 3/2003 |

OTHER PUBLICATIONS

Anthony Hill and William Furlow, New Tool Addresses ECD Problem, Offshore, Jun. 2002, pp. 88-89, U.S.A., retrieved May 14, 2012, from http://www.pennenergy.com/index/petroleum/display/149477/articles/offshore/volume-62/issue-6/departments/drilling-production/new-tool-addresses-ecd-problem.html, pp. 1-3.

P.A. Bern, et al., A New Downhole Tool for ECD Reducton, Feb. 19, 2003, pp. 1-4, SPE/IADC 79821, Society of Petroleum Engineers Inc., U.S.A.

Sven Krüger, TurboLift Advanced ECD Control, Apr. 2005, pp. 1-13, Baker Hughes Incorporated/INTEQ, U.S.A.

FLUID DRIVEN PUMP FOR REMOVING DEBRIS FROM A WELLBORE AND METHODS OF USING SAME

BACKGROUND

1. Field of Invention

The invention is directed to a downhole tool for placement in oil and gas wells for moving fluid upward through the tool, and in particular, to a downhole tool having a fluid driven pump for moving wellbore fluid upward.

2. Description of Art

Downhole tools for clean-up of debris in a wellbore are generally known and are referred to as "junk baskets." In general, the junk baskets have a screen or other structure that catches debris within the tool as fluid flows through the tool. This occurs because the fluid carrying the debris flows through the tool such that at a point in the flow path, the debris within the fluid engages a screen that prevents the debris from continuing on with the fluid.

In some instances, movement of the debris-laden fluid through the screen requires upward movement of the fluid. To facilitate upward movement of the fluid, a pump or other lifting mechanism can be used.

SUMMARY OF INVENTION

Broadly, downhole tools for movement of fluid through the tool comprise a rotatable sleeve disposed within a bore of the tool. In one specific embodiment, the sleeve is in rotational engagement with an inner wall surface of a tubular member. The sleeve comprises an opened upper end in fluid communication with a cavity for receiving a first fluid flowing in a first direction, the cavity being in fluid communication with one or more directional ports such that the flow of fluid flowing into the cavity exits the cavity through the one or more directional ports causing the sleeve to rotate. A lower end of the sleeve is closed off and comprises a fluid movement profile that facilitates movement of wellbore fluid disposed below the tool in a second direction to contact or engage the fluid movement profile of the lower end of the sleeve. In one particular embodiment, one or more ports is disposed in the tubular member in fluid communication with one or more of the directional ports to facilitate the flow of the first fluid out of the downhole tool and into the wellbore after the fluid exits the cavity through the one or more directional ports. In other particular embodiments, one or more ports is disposed in the tubular member in fluid communication with the fluid movement profile to facilitate the flow of the second fluid out of the downhole tool and into the wellbore after engaging the fluid movement profile. In certain specific embodiments, the port (s) in fluid communication with the directional port(s) is/are isolated from the port(s) in fluid communication with the fluid movement profile.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
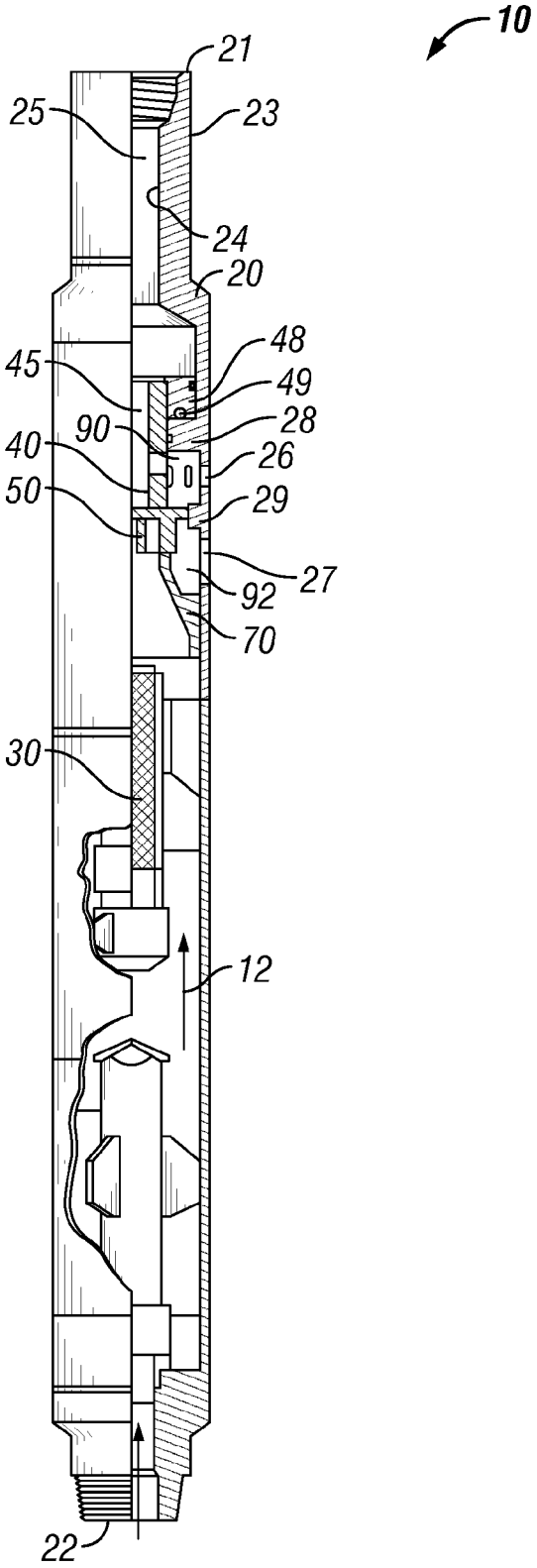
FIG. 1 is a partial cross-sectional view of a specific embodiment of a downhole tool disclosed herein.

Referring now to FIGS. 1-4, in one particular embodiment, downhole tool 10 comprises tubular member 20 (or housing or mandrel) having upper end 21, lower end 22, outer wall surface 23, inner wall surface 24 defining longitudinal bore 25, upper ports 26, and lower ports 27. Although tubular member 20 is shown in FIG. 1 as comprising several different sub-assemblies joined together, such as through threaded connections, it is to be understood that tubular member 20 can comprise a single member.

Disposed within bore 25 is screen member 30, sleeve 40, and fluid uptake member 70. Screen member 30 can be secured within bore 25 by any device or method known in the art such that fluid flowing through bore 25 from lower end 22 toward upper end 21, as indicated by the arrow 12 shown in FIG. 1, passes through screen member 30.

Figure 2:
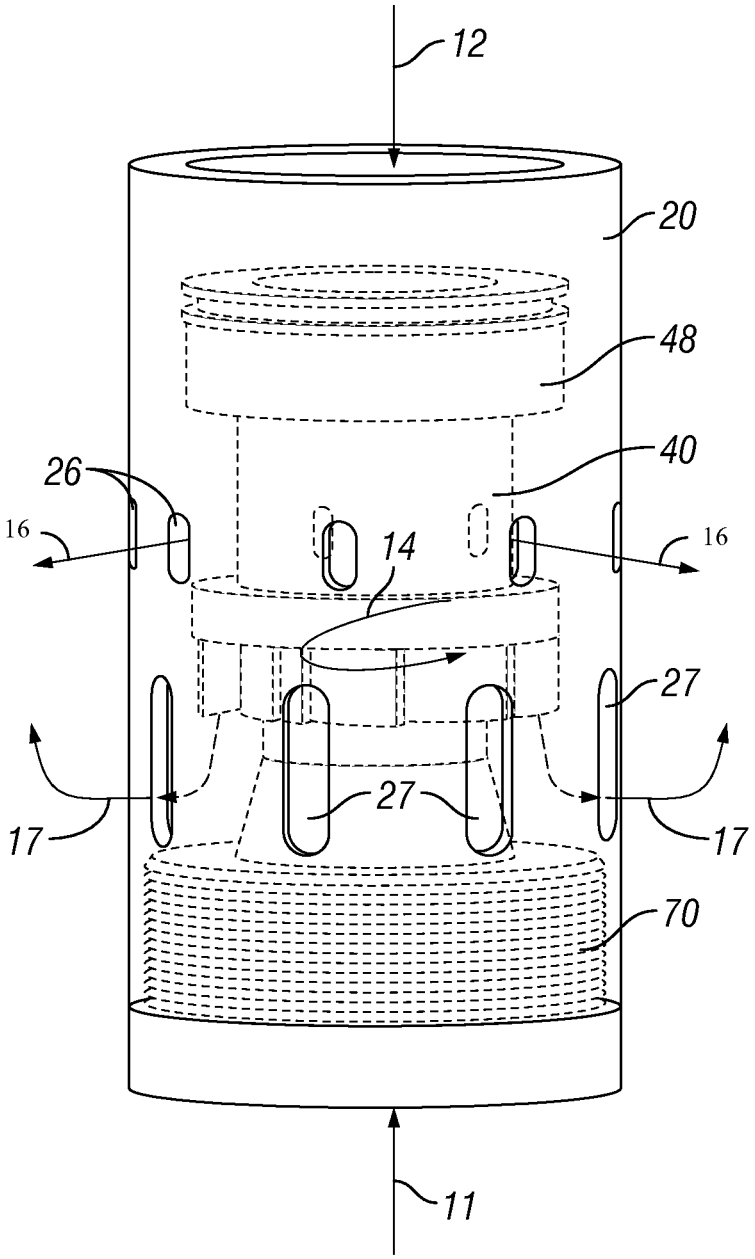
FIG. 2 is a partial perspective view of one specific embodiment of a rotatable sleeve and a fluid uptake member of the downhole tool shown in FIG. 1.
Figure 3:
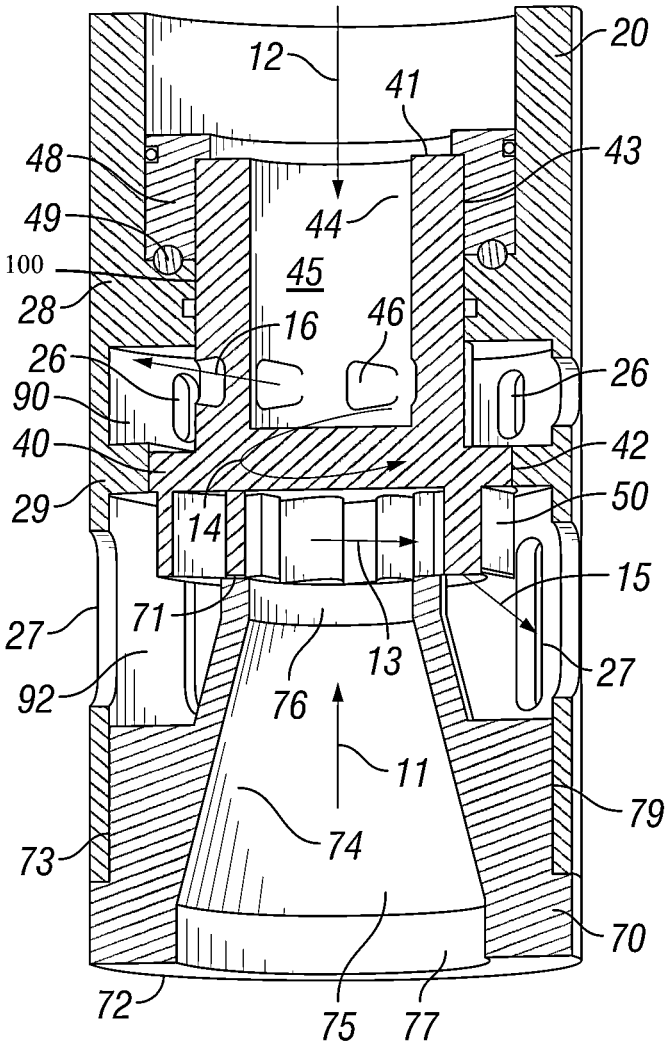
FIG. 3 is a cross-sectional view of the rotatable sleeve and fluid uptake member of the embodiment shown in FIG. 2.
Figure 4:
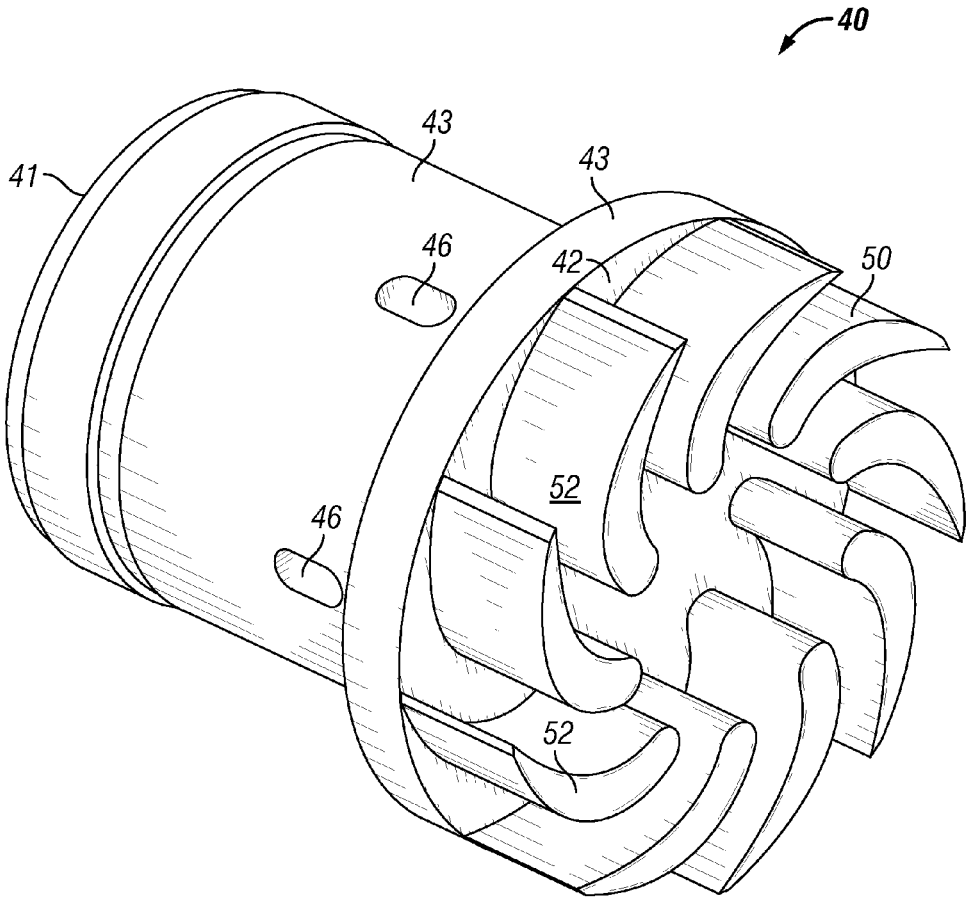
FIG. 4 is perspective view of the rotatable sleeve shown in FIGS. 2 and 3.

As best illustrated in FIGS. 2-4, sleeve 40 comprises upper end 41, lower end 42, outer wall surface 43, and inner wall surface 44. Lower end 42 is closed and upper end 41 is opened, i.e., includes a port, such that a fluid flowing in a first direction indicated by arrow 12 (FIGS. 2-3) enters cavity 45 which is defined by lower end 42 and inner wall surface 44. Disposed in the outer and inner wall surfaces 43, 44 are one or more directional ports 46. Each directional port 46 allows fluid to flow out of cavity 45 in the direction of arrow 16. Each directional port 46 is in fluid communication with upper ports 26 of tubular member 20. Due to the directional shape of each directional port 46, fluid flowing from cavity 45 through directional ports 46 causes rotation of sleeve 40 in the direction of arrow 14 (FIGS. 2-3).

To facilitate rotation of sleeve 40, in the embodiment of FIGS. 1-4, upper flange portion 48 is disposed at upper end 41 of sleeve 40. As shown in the Figures, in this embodiment, upper flange portion 48 is a separate member that is secured to outer wall surface 43 of sleeve 40 by a fastener such as a threaded connection 100, although other devices and methods can be used. It is to be understood, however, that upper flange portion 48 is not required to be a separate member. To the contrary, upper flange portion 48 can be formed as a single piece with sleeve 40. Additionally, other devices or mechanisms known in the art can be either secured to, or formed together with, sleeve 40 to facilitate rotation of sleeve 40.

As shown in the embodiment of FIGS. 1-4, upper flange portion 48 is in sliding engagement with an upper surface of upper shoulder 28 disposed on inner wall surface 24 of tubular member 20. To facilitate rotation of upper flange portion 48 and, thus, sleeve 40, bearing 49 is operatively associated with a lower surface of upper flange portion 48 and the upper surface of shoulder 28.

Although upper flange portion 48 and bearing 49 are shown in the embodiment of FIGS. 1-4 to facilitate rotation of sleeve 40, it is to be understood that sleeve 40 can be in rotatable engaged with inner wall surface 24 of tubular member 20 through any method or device known in the art. For example, upper shoulder 28, upper flange portion 48, and bearing 49 could be absent such that rotation of sleeve 40 is facilitated by only one or more portions of outer wall surface 43 of sleeve 40 being in rotational engagement with inner wall surface 24 of tubular member 20.

As discussed above, and shown best in FIGS. 2-3, directional ports 46 are in fluid communication one or more of upper ports 26 of tubular member 20 so that a fluid flowing from cavity 45 through directional ports 46 can flow into the wellbore (not shown). To further facilitate the flow of a fluid in this manner, lower shoulder 29 can be disposed on inner wall surface 24 of tubular member 20. As shown beset in FIGS. 2-3, a portion of outer wall surface 43 of sleeve 40 is in sliding engagement with an inner diameter wall surface of lower shoulder 29. As a result, upper ports 26 are isolated from lower ports 27 by lower shoulder 29 and sleeve 40.

As further shown in FIGS. 1-3, the outer diameter of outer wall surface 43 forming cavity 45 is less than the outer diameter of the portion of outer wall surface 43 that is in rotational engagement with the inner diameter wall surface of lower shoulder 28. Thus, a portion of outer wall surface 43 has an outer diameter of sleeve 40 that is less than the inner diameter of a portion of inner wall surface 24. As a result, upper shoulder 28 has an inner diameter that is smaller than the inner diameter of lower shoulder 29. This arrangement between inner wall surface 24, upper shoulder 28, lower shoulder 29, and sleeve 40 defines upper port chamber 90 within bore 25 of tubular member 20. In addition, by engaging with inner diameter wall surface of lower shoulder 29, sleeve 40 is more stable during rotation.

Disposed on closed lower end 42 of sleeve 40 is fluid movement profile 50. Fluid movement profile 50 can be any profile that, when rotated, causes fluid to move upward in the direction of arrow 11 (FIGS. 2-3). In the embodiment of FIGS. 1-4, fluid movement profile 50 comprises a plurality of fins or vanes 52 each shaped to cause fluid to be pulled upward in the direction of arrow 11 to engage or contact the plurality of vanes 52. As sleeve 40 continues to rotate, the fluid is moved out of lower ports 27 into the wellbore (not shown), as indicated by arrows 17 in FIG. 2.

Disposed in close proximity to fluid movement profile 50 is fluid uptake member 70. Fluid uptake member 70 comprises upper end 71, lower end 72, outer wall surface 73, and inner wall surface 74 defining bore 75. In the embodiment of FIGS. 1-4, bore 75 comprises an inverted conical-shaped such having upper end opening 76 that is smaller than lower end opening 77. Thus, in the embodiment shown in the Figures, the shape of bore 75 facilitates movement of fluid upward in the direction of arrow 11 to engage or contact fluid movement profile 50.

As also shown in FIGS. 2-3, fluid uptake member 70 is secured to tubular member 20 through threads 79. As a result, a portion of outer wall surface 73 of fluid uptake member 70 provides a portion of outer wall surface 23 of tubular member 20. It is to be understood, however, that fluid uptake member 70 is not required to be secured to tubular member 20 in this manner. To the contrary, fluid uptake member 70 can be secured to tubular member 20 in any manner or using any device known in the art. For example, fluid uptake member 70 can be secured to inner wall surface 24 of tubular member through a threaded connection between outer walls surface 73 and inner wall surface 24.

As further shown in FIGS. 1-3, the outer diameter of outer wall surface 73 is not consistent between upper end 71 and lower end 72 of fluid uptake member 70. As shown best in FIGS. 2-3, a portion of outer wall surface 73 is in contact with inner wall surface 24 of tubular member 20, however, another portion of outer wall surface 73 is angled inwardly as outer wall surface 73 approaches upper end 71. Thus, a portion of outer wall surface 73 has an outer diameter of fluid uptake member 70 that is less than the inner diameter of a portion of inner wall surface 24. This arrangement between inner wall surface 24, lower shoulder 29, sleeve 40, and fluid uptake member 70 defines lower port chamber 92 within bore 25 of tubular member 20.

Sleeve 40 and fluid uptake member 70 can be formed out of any desired or necessary material to facilitate rotation of sleeve 40 and, thus, movement of fluid upward into fluid movement profile 50. In one embodiment, both sleeve 40 and fluid uptake member 70 are formed of metal such as steel. In another embodiment, one or both of sleeve 40 and fluid uptake member 70 is formed of a non-metallic material to reduce weight.

In operation, downhole tool 10 is included as part of a tubing or work string that is then disposed within a wellbore at a desired location. A first fluid is pumped down the string and into bore 25 of tubular member 20. The first fluid then enters cavity 45 of sleeve 40 through upper end 41 in the direction of arrow 12 and flows through directional ports 46, into upper port chamber 90 through upper ports 26, and into the wellbore (not shown). In so doing, sleeve 40 is rotated in the direction of arrow 14 (FIG. 2).

Rotation of sleeve 40 causes a second fluid located below sleeve 40 to be pulled upward in the direction of arrow 11. The second fluid can be a fluid within bore 25 below sleeve 40 and/or wellbore fluid, presuming bore 25 is fluid communication with a wellbore at a lower end of either tubular member 20 or a lower end of the work string. In one particular embodiment, the lower end of tubular member 20 is in fluid communication with a wellbore such that wellbore fluid containing debris is pulled upward through downhole tool 10. In so doing, the debris-laden wellbore fluid contacts screen 30 such that the debris is prevented from continuing upward movement through downhole tool 10. The wellbore fluid continues to be pulled upward by the rotation of sleeve 40 until it contacts or engages fluid movement profile 50. Upon engagement with fluid movement profile 50, the wellbore fluid is moved in the direction of arrow 13 (FIG. 3) toward lower port chamber 92. Thereafter, the wellbore fluid flows in the direction of arrow 15 (FIG. 3) into lower port chamber 92 and then through lower ports 27 (arrows 17 in FIG. 2) and into the wellbore. This operation can continue until screen 30 becomes too blocked by debris such that further circulation of fluid upward through screen 30 and, thus, into fluid movement profile 50 and through lower ports 27 can no longer be effectively accomplished, or until sufficient debris has been removed from the wellbore fluid such that further downhole operations can be performed.

It is to be understood that the invention is not limited to the exact details of construction, operation, exact materials, or embodiments shown and described, as modifications and equivalents will be apparent to one skilled in the art. For example, fluid uptake member is not required to included as part of the tool. In addition, in embodiments in which fluid uptake member is included, the bore of fluid uptake member is not required to have an inverted conical-shape. Moreover, one or both of the upper port chamber and the lower port chamber is not required. Further, the fluid movement profile is not required to include fins or vanes as shown in the Figures, but instead can comprise any profile that causes fluid to be pulled upward in the direction of arrow 11 shown in FIGS. 2-3. Additionally, upper port(s) and lower port(s) can be the same size, or the upper port(s) can be larger than the lower port(s), or the upper port(s) can be smaller than the lower port(s). In addition, the tubular member can comprise a single upper port or two or more upper ports. Similarly, the tubular member can comprises a single lower port or two or more lower ports. Further, the sleeve can comprise a single directional port, or two or more directional ports. Moreover, the tubular member can be formed using a single tubular member or assembled by connecting two or more components or sub-assemblies such as through threaded connections. In addition, the fluid intake member can be included in the tool in any manner known to those skilled in the art such as by securing the outer wall surface of the fluid intake member to the inner wall surface of the tubular member or, as shown in the Figures, securing a portion of the fluid intake member directly to the tubular member through threads. Further, it is to be understood that the term "wellbore" as used herein includes open-hole, cased, or any other type of wellbores. In addition, the use of the term "well" is to be understood to have the same meaning as "wellbore." Accordingly, the invention is therefore to be limited only by the scope of the appended claims.

What is claimed is:

1. A downhole tool for moving fluid through the downhole tool, the downhole tool comprising:

a tubular member having an upper end, a lower end, an outer wall surface, an inner wall surface defining a longitudinal bore, an upper port disposed between the outer wall surface and the inner wall surface, and a lower port disposed between the outer wall surface and the inner wall surface, the upper port being isolated from the lower port; and a sleeve in rotatable engagement with the inner wall surface of the tubular member, the sleeve at least partially isolating the upper port from the lower port, the sleeve having a sleeve upper end and a sleeve lower end, the sleeve upper end having a sleeve upper end port and the sleeve lower end being closed thereby partially defining a sleeve cavity in fluid communication with the sleeve upper end port, the sleeve cavity having a directional port disposed through a sleeve inner wall surface partially defining the sleeve cavity and a sleeve outer wall surface, the directional port being in fluid communication with the upper port of the tubular member, such that flow through said directional port causes rotation of said sleeve, the sleeve lower end having a fluid movement profile extending no lower than said lower port for facilitating movement of the fluid from the lower end of the tubular member through the lower port of the tubular member.

2. The downhole tool of claim 1, wherein the tubular member further comprises an upper port chamber disposed between and in fluid communication with the directional port and the upper port of the tubular member.

3. The downhole tool of claim 1, wherein the tubular member further comprises a lower port chamber disposed between and in fluid communication with the fluid movement profile of the sleeve lower end and the lower port of the tubular member.

4. The downhole tool of claim 3, wherein the lower port chamber is at least partially defined by a fluid uptake member disposed within the tubular member below the sleeve.

5. The downhole tool of claim 4, wherein the fluid uptake member comprises an inverted conically-shaped bore having an upper bore end and a lower bore end, the upper bore end having an upper bore opening that is smaller than a lower bore opening of the lower bore end.

6. The downhole tool of claim 1, wherein the sleeve comprises a plurality of directional ports.

7. The downhole tool of claim 1, wherein the fluid movement profile comprise a plurality of directional vanes.

8. The downhole tool of claim 1, wherein the lower port is larger than the upper port.

9. The downhole tool of claim 1, further comprising a fluid uptake member disposed within the tubular member below the sleeve to facilitate movement of the fluid upward into contact with the fluid movement profile.

10. The downhole tool of claim 9, wherein the tubular member further comprises an upper port chamber disposed between and in fluid communication with the directional port and the upper port of the tubular member, and a lower port chamber disposed between and in fluid communication with the fluid movement profile of the sleeve lower end and the lower port of the tubular member.

11. The downhole tool of claim 10, wherein the lower port chamber is at least partially defined by the fluid uptake member, and the fluid uptake member comprises an inverted conically-shaped bore having an upper bore end and a lower bore end, the upper bore end having an upper bore opening that is smaller than a lower bore opening of the lower bore end.

12. The downhole tool of claim 11, wherein the lower port is larger than the upper port.

13. A downhole tool for moving fluid through the downhole tool, the downhole tool comprising:

a tubular member having an upper end, a lower end, an outer wall surface, an inner wall surface defining a longitudinal bore, an upper port disposed between the outer wall surface and the inner wall surface, and a lower port disposed between the outer wall surface and the inner wall surface, the upper port being isolated from the lower port; and a sleeve in rotatable engagement with the inner wall surface of the tubular member, the sleeve at least partially isolating the upper port from the lower port, the sleeve having a sleeve upper end and a sleeve lower end, the sleeve upper end having a sleeve upper end port and the sleeve lower end being closed thereby partially defining a sleeve cavity in fluid communication with the sleeve upper end port, the sleeve cavity having a directional port disposed through a sleeve inner wall surface partially defining the sleeve cavity and a sleeve outer wall surface, the directional port being in fluid communication with the upper port of the tubular member, the sleeve lower end having a fluid movement profile for facilitating movement of a fluid from the lower end of the tubular member through the lower port of the tubular member;

the sleeve comprises an upper flange portion that is disposed on a shoulder disposed on the inner wall surface of the tubular member to facilitate rotation of the sleeve.

14. The downhole tool of claim 13, wherein the upper flange portion is operatively associated with a bearing, the bearing being operatively associated with the shoulder, to facilitate rotation of the sleeve.

15. The downhole tool of claim 14, wherein the upper flange portion is formed separately from the sleeve, the upper flange portion being secured to the sleeve outer wall surface by a fastener.

16. A method of moving fluid through a downhole tool, the method comprising the steps of:

(a) flowing a first fluid downward through a bore of a downhole tool into a cavity of a rotatable sleeve, (b) passing the first fluid through a directional port disposed in the rotatable sleeve causing the rotatable sleeve to rotate;

(c) moving a second fluid upward within the downhole tool into contact with a lower end of the rotatable sleeve that extends no further than a lower port during step (b);

(d) passing into a wellbore environment the first fluid through an upper port disposed in a wall of the downhole tool; and (e) passing into a wellbore environment the second fluid through said lower port disposed in the wall of the downhole tool, the lower port being isolated from the upper port.

17. The method of claim 16, wherein during step (c), the second fluid is moved through a screen disposed below the rotatable sleeve.

18. The method of claim 17, wherein during step (c), the second fluid is moved upward by fluid movement profile disposed on the lower end of the sleeve.

19. The method of claim 17, wherein the first fluid flows into an upper chamber disposed within the bore of the downhole tool prior to step (d), and the second fluid flows into a lower chamber disposed within the bore of the downhole tool prior to step (e).

20. The method of claim 17, the second fluid is passed through an inverted conically-shaped uptake member prior to (c).

* * * * *